US008608407B1

(12) United States Patent
Vaughn et al.

(10) Patent No.: US 8,608,407 B1
(45) Date of Patent: Dec. 17, 2013

(54) TOP-LOCK CONNECTOR FOR A FLOATING DOCK

(75) Inventors: Michael D. Vaughn, Ketchum, OK (US); Paul Bradley Forrest, Cary, NC (US)

(73) Assignee: HydroHoist Marine Group, Inc., Claremore, OK (US)

( * ) Notice: Subject to any disclaimer, the term of this patent is extended or adjusted under 35 U.S.C. 154(b) by 161 days.

(21) Appl. No.: 13/183,167

(22) Filed: Jul. 14, 2011

Related U.S. Application Data

(60) Provisional application No. 61/364,679, filed on Jul. 15, 2010.

(51) Int. Cl.
*B63C 1/02* (2006.01)

(52) U.S. Cl.
USPC ..... 405/219; 403/294; 403/297; 403/374.3

(58) Field of Classification Search
USPC ..... 403/292, 294, 297, 374.2, 374.3, 403/DIG. 10, DIG. 13; 405/219; 114/263, 114/267
See application file for complete search history.

(56) References Cited

U.S. PATENT DOCUMENTS

| | | | | | |
|---|---|---|---|---|---|
| 4,453,488 | A | | 6/1984 | Watchorn | |
| 4,714,042 | A | * | 12/1987 | Schulte | 114/266 |
| 4,979,453 | A | | 12/1990 | Sloan et al. | |
| 5,251,560 | A | * | 10/1993 | Ban et al. | 114/266 |
| 5,281,055 | A | | 1/1994 | Neitzke et al. | |
| 5,333,557 | A | * | 8/1994 | Eickhoff | 403/293 |
| 5,529,013 | A | | 6/1996 | Eva, III et al. | |
| 5,682,833 | A | | 11/1997 | Eva, III et al. | |
| 5,947,050 | A | | 9/1999 | Eva, III et al. | |
| 6,073,572 | A | | 6/2000 | Gruhn et al. | |
| 6,095,713 | A | * | 8/2000 | Doyle et al. | 403/370 |
| 6,179,525 | B1 | | 1/2001 | Gruhn et al. | |
| 6,205,945 | B1 | | 3/2001 | Passen et al. | |
| 6,308,652 | B1 | | 10/2001 | O'Neill | |
| 6,431,106 | B1 | | 8/2002 | Eva, III et al. | |
| 6,526,902 | B1 | | 3/2003 | Faber | |
| 6,659,033 | B1 | | 12/2003 | Donley | |
| 6,851,893 | B1 | | 2/2005 | Bridgeman | |
| 6,969,211 | B2 | * | 11/2005 | Altman | 403/374.4 |
| 7,225,751 | B2 | * | 6/2007 | Rueckert | 114/263 |
| 7,243,608 | B2 | | 7/2007 | Knight, Jr. et al. | |
| 7,255,055 | B2 | | 8/2007 | Whybourne | |
| 2005/0008437 | A1 | | 1/2005 | Surges | |
| 2005/0204989 | A1 | | 9/2005 | Ahern | |
| 2007/0256612 | A1 | | 11/2007 | Klemm et al. | |
| 2009/0151616 | A1 | * | 6/2009 | Han | 114/266 |

* cited by examiner

*Primary Examiner* — Michael P Ferguson
(74) *Attorney, Agent, or Firm* — GableGotwals

(57) ABSTRACT

A connector for connecting together two floating dock sections includes a first half having a pair of slotted cylinders and a second half with a pair of cones. A pair of rods connects the first half to the second half. When the two halves are loosely connected together, the connector is inserted into opposing receiver sockets of a pair of opposing floating dock members. A flange located at an upper end of the first half arrests the downward travel of the inserted and loosely connected first and second halves. As the rods are tightened, the pair of cones travel toward the pair of slotted cylinders and cause the slotted cylinders to expand radially outward.

1 Claim, 3 Drawing Sheets

TOP-LOCK CONNECTOR FOR A FLOATING DOCK

CROSS REFERENCE TO APPLICATIONS

This application claims priority to U.S. Provisional Pat. Appl. No. 61/364,679 filed Jul. 15, 2010.

BACKGROUND OF THE INVENTION

This invention generally relates to connecting means for securing together two or more floating dock members like those used to provide a docking surface for a personal watercraft. More specifically, the invention relates to connecting means used for the above purpose and designed so that the connection may be made by a user entirely from the topside of the floating dock members.

Problems with current connecting means include (1) difficulty in making the connection because the connection cannot be accomplished entirely from the topside of the docks; (2) there is no failure point so that if the connected floating docks experience a certain level of turbulence or a excessive impact resulting from a collision with a watercraft, a portion of the docking member breaks rather than the connector; and (3) the fastening means of the connector experience continued exposure to water.

SUMMARY OF THE INVENTION

Objects of this invention are to provide a means for connecting two or more floating docks together that (1) can be accomplished entirely from the topside of the docks; (2) includes a failure point so that if the connected floating docks experience a certain level of turbulence or a excessive impact resulting from a collision with a watercraft, the connector breaks rather than the docking members; (3) isolates fastening means of the connector from continued exposure to water; and (4) does not run substantially from the bottom of the dock to a point at or near the top of the dock in order to connect the docks.

ELEMENTS AND LABELS USED IN THE DRAWINGS AND DETAILED DESCRIPTION

Figures 1, 2:
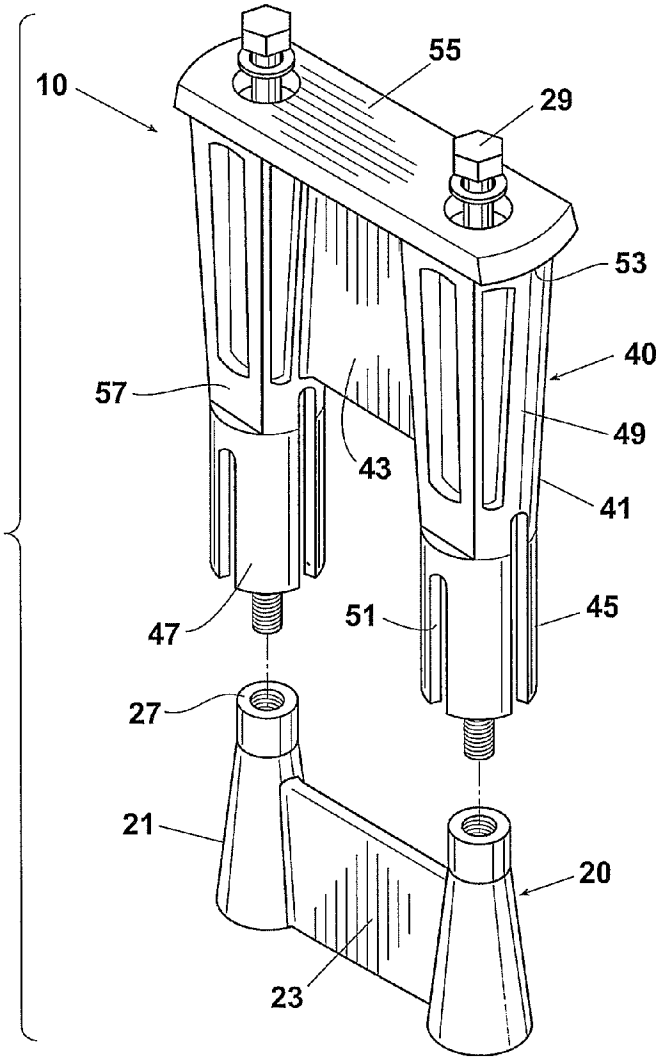
FIG. 1 is an exploded view of the top and bottom portions of the top-lock connector of FIG. 1 in the connector's disassembled or fully disconnected state.
FIG. 2 is front elevation view of the top-lock connector of FIG. 1 in its loosely connected state.
Figure 3:
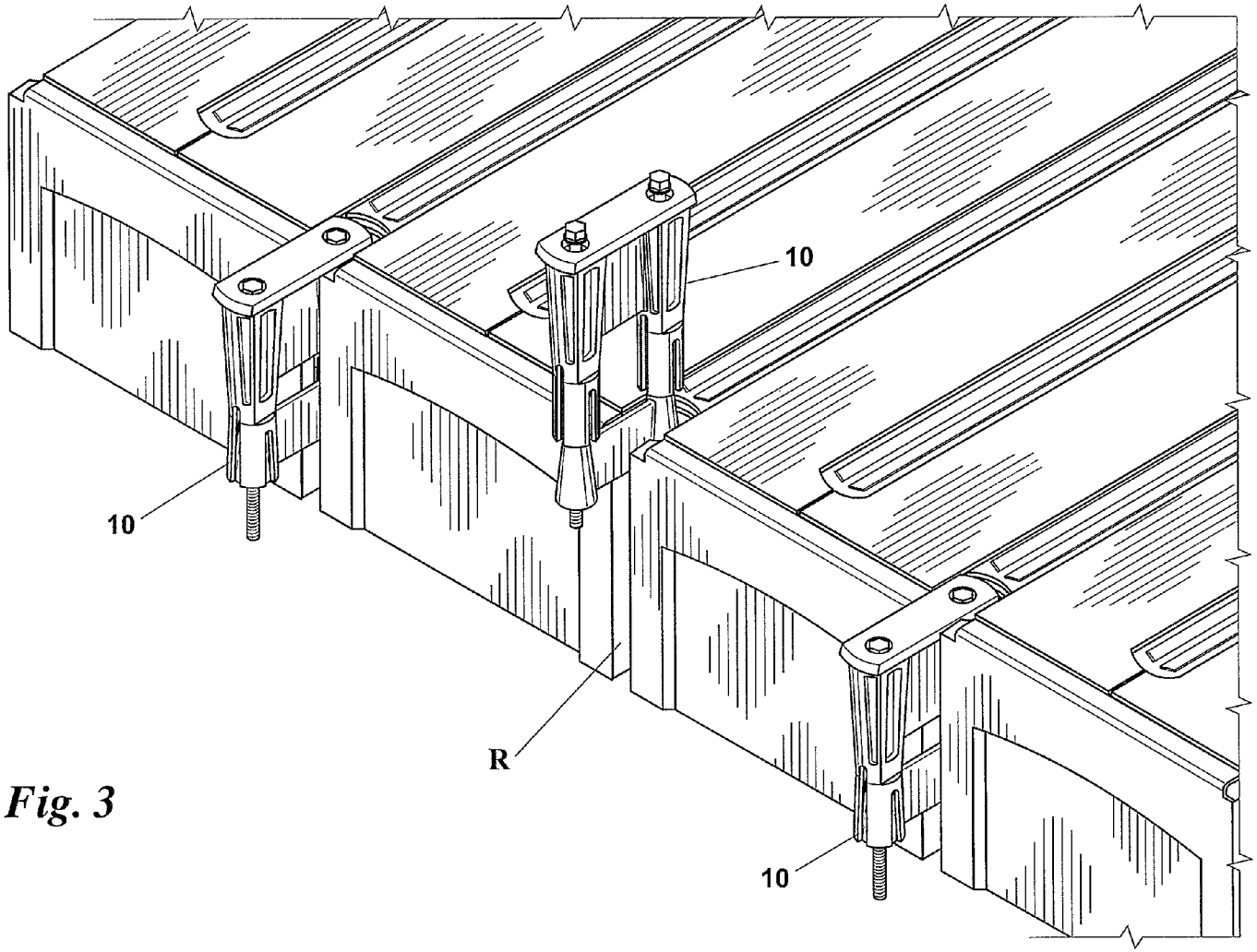
FIG. 3 is an isometric view of the top-lock connector of FIG. 1 in its loosely connected state and being inserted from the top side of a floating dock member into a receiver socket of the dock member.
Figure 4:
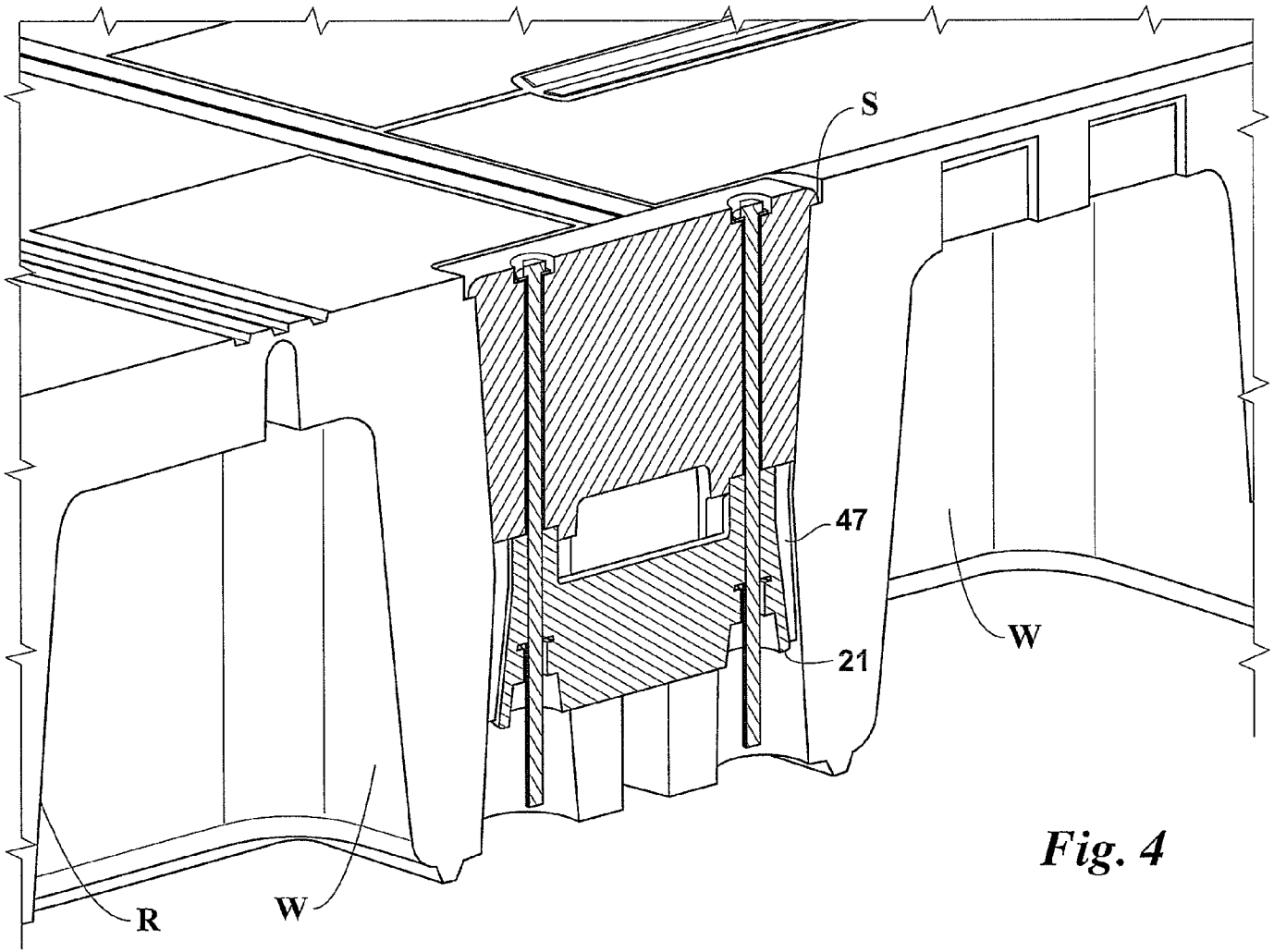
FIG. 4 is a cross section view of the top-lock connector of FIG. 1 in its fully connected state and connecting together two opposing floating dock members.

| | |
|---|---|
| 10 | top-lock connector |
| 20 | first half of 10/lower male portion |
| 21 | cone |
| 23 | center section or spacer |
| 25 | threaded receiver |

-continued

| | |
|---|---|
| 27 | upper end of cone 21 |
| 29 | bolt or rod |
| 40 | second half of 10/upper female portion |
| 41 | cone |
| 43 | center section or spacer |
| 45 | slotted cylinder |
| 47 | walls of slotted cylinder |
| 49 | outer side wall of cone 41 |
| 51 | slot of slotted cylinder 45 |
| 53 | upper end of 40 |
| 55 | flange |
| 57 | front or rear wall of cone 41 |
| D | floating dock member |
| R | receiver slot of D |
| S | shelf portion of R |
| T | top side of D |
| W | wall surface of R |

DESCRIPTION OF THE PREFERRED EMBODIMENTS

A top-lock connector 10 made according to this invention is an expandable two-part connector that is received by vertical receiver slots R in opposing floating dock members D and spans between about the top end and midline of the dock members D. The first half or lower male portion 20 of the top-lock connector includes a pair of frusto-conical shaped cones 21 connected by a narrower center section or spacer 23. Each cone 21 has a female threaded receiver 25 located at its upper end 27 for receiving a bolt or rod 29. The bolt or rod 29 may be a plastic or composite material bolt or rod. As a user tightens the rod 29, the pair of frusto-conical shaped cones 21 are drawn upward and into the second half or upper female portion 40 of the top-lock connector 10.

The upper female portion 40 of the top-lock connector 10 includes a pair of ribbed frusto-conical shaped cones 41 which reside above a slotted cylinder 45. Similar to the cones 21 of the lower male portion 20, the ribbed cones 41 of the upper female portion 40 are connected together by a narrower center section or spacer 43. The side outer wall 49 of each ribbed cone 41, that is the portion of the ribbed cone 41 that faces an opposing wall surface W of a receiver socket R in the floating dock member D, is preferably a curved wall surface and shaped complementary to the opposing wall surface W of the receiver socket R. The front, rear, or front and rear walls 57 of the cones 41 may be a flat or other shaped surface, again complementary to the opposing wall surface W of the receiver socket R. Each slotted cylinder 45 has a slot 51 for receiving the spacer 23 of the lower male portion 20 of the connector 10 as that portion 20 is threaded upward.

Prior to connecting the two docking members D together, the female portion 40 of the top-lock connector 10 is preferably loosely connected to the male portion 20 and this loosely assembled connector 10 is then inserted from the top side T the docking members D into the opposing receiver sockets R the two dock members D. A flange portion 55 located at the upper end 53 of the female connector 40 engages a shelf portion S of each receiver socket R and prevents additional downward travel of the connector 10. As the rod 29 is tightened, the male portion 20 of the connector 10 is drawn upward and into the slotted cylinder 45. As this portion 20 continues its upward travel, it begins to force the walls 47 of the slotted cylinder 45 outward so as to urge or press a portion of the cylinder 45 against the walls W of the receiver socket R. In its fully deployed state, the connector 10 is effective for gripping the opposing receiver sockets R at about the midline of the docking members D without popping the connector 10 out of the receiver sockets R. The connector 10 itself is preferably dimensioned so that in its deployed state, its length is less than the depth of the docking members D.

The invention claimed is:

1. A connector for connecting a pair of opposing floating dock members, each floating dock member having a vertically oriented receiver slot, the receiver slot located on a periphery of the floating dock member and extending from a topside of the floating dock member past a midline of the floating dock member, the receiver slot having an axially-extending cylindrical wall portion and an axially-extending planar slot portion disposed at the periphery, the connector comprising:

a upper half and a lower half that when loosely connected one to the other are adapted for topside-down insertion into the receiver slot and top-side removal from the receiver slot, the connector sized to extend from the topside of the floating dock member past the midline of the floating dock member and arranged to move between a loosely connected state and a tightly connected state;

the lower half of the connector including a pair of parallel axially-extending cones connected by an axially-extending planar center spacer, the upper half of the connector including a pair of parallel axially-extending slotted cylinders each comprising a plurality of axially-extending slots and connected by an axially-extending planar center spacer, each cone sized for insertion into its respective slotted cylinder, each slotted cylinder sized for insertion into the cylindrical wall portion of a respective floating dock member, and the center spacers of the upper and lower halves being sized for insertion into the planar slot portions of the dock members, a base diameter of each cone being greater than an inner diameter of its respective slotted cylinder;

a pair of threaded rods, each rod in the pair of rods passing through a respective slotted cylinder in the pair of slotted cylinders and being received by a correspondingly threaded upper portion of a respective cone in the pair of cones, each rod when tightened drawing the respective cone upward toward the respective slotted cylinder, such that the center spacer of the lower half is received within a corresponding slot of each of the slotted cylinders and the cones radially expand the slotted cylinders to clamp against the cylindrical wall portion of each receiver slot, and moving the connector between the loosely connected state and the tightly connected state;

a flange located at an upper end of the upper half and receivable within a shelf portion recessed within the topside of each floating dock member to arrest the downward travel of the upper half when in the loosely connected state and while being inserted into the receiver slots.

* * * * *